US005883319A

United States Patent [19]

Hebestreit et al.

[11] Patent Number: 5,883,319

[45] Date of Patent: Mar. 16, 1999

[54] STRINGS FOR MUSICAL INSTRUMENTS

[75] Inventors: Charles G. Hebestreit, Flagstaff; David J. Myers, Camp Verde, both of Ariz.

[73] Assignee: W.L. Gore & Associates, Inc., Newark, Del.

[21] Appl. No.: 561,774

[22] Filed: Nov. 22, 1995

[51] Int. Cl.[6] ..... G10D 3/00; G10D 3/10

[52] U.S. Cl. ..... 84/297 S; 84/199

[58] Field of Search ..... 84/199, 297 S

[56] References Cited

U.S. PATENT DOCUMENTS

| | | | |
|---|---|---|---|
| 3,826,171 | 7/1974 | Kaar | 84/297 S |
| 3,953,566 | 4/1976 | Gore | 264/288 |
| 3,962,153 | 6/1976 | Gore | 260/2.5 R |
| 4,096,227 | 6/1978 | Gore | 264/210 R |
| 4,187,390 | 2/1980 | Gore | 174/102 R |
| 4,326,444 | 4/1982 | Markley | 84/297 |
| 4,339,499 | 7/1982 | Tappe et al. | 428/373 |
| 4,382,358 | 5/1983 | Tappe et al. | 57/243 |
| 4,539,228 | 9/1985 | Lazarus | 427/180 |
| 5,107,852 | 4/1992 | Davidson et al. . | |
| 5,535,658 | 7/1996 | Kalosdian | 84/297 |
| 5,610,348 | 3/1997 | Aladin | 84/297 |

FOREIGN PATENT DOCUMENTS

| | | |
|---|---|---|
| 963830 | 5/1957 | Germany . |
| 3133231 A | 3/1983 | Germany . |
| 3326006 | 1/1985 | Germany . |
| 4109334 A1 | 11/1992 | Germany . |
| 63-182441 | 7/1988 | Japan . |
| 63-057799 | 11/1988 | Japan . |
| 690031 | 4/1953 | United Kingdom . |
| 2187217 | 9/1987 | United Kingdom . |
| 9001766 | 2/1990 | WIPO . |

OTHER PUBLICATIONS

Catalog: "Kaman Reference Manual & Music Products Catalog." Kaman Music Corporation 1994 pp. 67, 78.

Fleishman, H. Gauging Strings: How to get the most out of today's steel and nylon strings. Acoustic Guitar Oct. 1996; pp. 65–73.

*Primary Examiner*—William M. Shoop, Jr.
*Assistant Examiner*—Marlon T. Fletcher
*Attorney, Agent, or Firm*—David J. Johns

[57] ABSTRACT

An improved musical instrument string is provided. The string includes a polymer cover that protects the string, from contamination while maintaining the original "lively" sound of the musical string. By supplying the cover over a conventional string and preferable over a conventional wound string, the string is protected against contamination while also making the string easier to play. The preferred cover comprises at least one layer of expanded polytetrafluoroethylene (ePTFE) that is most preferably sealed with a polymer coating.

40 Claims, 8 Drawing Sheets

STRINGS FOR MUSICAL INSTRUMENTS

BACKGROUND OF THE INVENTION

1. Field of the Invention

The present invention relates to strings for musical instruments, and particularly to strings for musical instruments such as strings for guitars and the like that may be contaminated along their length and/or may cause undue finger discomfort when played.

2. Description of Related Art

There are a multitude of different types of musical strings employed today, each performing a different function. A typical guitar employs a straight (nonwound) string (such as "catgut," metal, or synthetic polymer (e.g., those disclosed in U.S. Pat. Nos. 4,339,499 and 4,382,358)) for higher pitched notes, and wound metal or polymer strings (usually a wrapped metal or polymer winding over a core of nylon or similar material) for lower pitch notes. Wound strings rely on the additional string mass per unit length supplied by the spiral wrap of the wound string to supply lower pitched notes at an acceptable string tension. Existing string designs have been refined over many years to provide excellent musical tones, but the strings continue to be limited in many respects.

There is a large variety of stringed musical instruments employed today that require human contact along at least a portion of the strings, such as in the fingering and plucking of guitar strings in order to be played. While straight gage strings can be easily wiped of dirt and oil after use, wound strings tend to become contaminated with dirt, skin oils, and perspiration after even a few hours of playing. It is believed that dirt and other contaminants infiltrate windings of the string causing the windings to have limited motion. After a relatively short period of time, a typical wound string will become musically "dead," apparently due to the build-up of this contamination. Presently wound strings that lose their tonal qualities must be removed from the instrument and either cleaned or replaced. This process is burdensome, time consuming, and expensive for musicians who play frequently and care about tonal quality.

Another problem encountered with strings requiring fingering along a fingering board (e.g., a guitar fret board) is that a substantial amount of pressure must often be applied by the musician against the fingering board in order to produce different musical notes. This can be discouraging for beginning music students. Accomplished musicians normally develop extensive calluses on their fingers from years of playing their instruments. Despite such calluses, the pressure and friction generated by playing the instruments tends to be one of the primary causes of frustration and fatigue or injury for many musicians.

Still another problem with conventional strings, and particularly conventional wound strings, is that the action of fingering quickly across the strings often generates unwanted noises. For instance, it is common to hear a "squeak" from guitar wound strings as a musician fingers rapidly across a fret board or finger board. In order to avoid such squeaks, the musician must make a concerted effort to completely separate his or her fingers from the strings when repositioning on the fret or finger board. This repositioning action slows the musician's note changes and further increases fatigue.

It would seem that some of these problems could be addressed if the strings could be coated with some substance to avoid contamination of the wound string windings and/or to provide some cushioning or smooth, non-squeak, cover for the strings. For example, Fender Corporation offers a bass guitar string that employs a spiral wrap of a flat, stiff polymer tape (such as nylon) around the wound string. The polymer tape is not adhered to the wound string and does not conform to the underlying bass string, but, instead, is held in place merely by tightly helically wrapping the stiff flat tape around the bass string and holding the tape from unwinding with an outer-wrapping of thread at each end of the guitar string. The polymer tape is wrapped with its side edges abutting without overlap of or adhesion to adjacent tape wraps.

While Fender Corporation's use of a stiff tape wrap may help reduce some contamination problems or may make the string somewhat more comfortable to play (neither of which results appears to be claimed or established by Fender), the Fender bass guitar string has a distinctly "dead" sound when played. The relatively heavy and stiff wrapping is believed to limit the amount and duration of vibration of the string, particularly at higher harmonic or overtone frequencies, muffling or "deadening" its sound. As a result of the use of such a non-deformable covering, the string is unsuitable for most guitar applications where a conventional "bright" or "lively" guitar sound is sought.

It is accordingly a primary purpose of the present invention to provide an improved musical instrument string that maintains close to a conventional lively sound while being resistant to contamination over a longer period of time than conventional strings.

It is a further purpose of the present invention to provide an improved musical instrument string that is faster, easier, and/or more comfortable to play than conventional strings.

It is still another purpose of the present invention to provide an improved musical instrument string that is less prone to generating unwanted noises when a musician's fingers are moved along the string.

These and other purposes of the present invention will become evident from review of the following description.

SUMMARY OF THE INVENTION

The present invention is an improved musical instrument string for use on a variety of stringed musical instruments, including but not limited to guitars, double basses, pianos, violins, cellos, etc. The present invention is particularly suitable for use on musical instruments with strings that are prone to contamination and change in tonal quality over time, such as guitars and other instruments that have strings that are extensively handled during use.

The string of the present invention can employ a conventional wound string, such as a string having a center core and a spiral winding used to produce lower notes, and a polymer cover applied around and adhered to the wound string. The preferred cover comprises porous polytetrafluoroethylene (PTFE) in the form of one or more tapes, sheets, or tubes that enwrap the wound string and protect the wound string from contamination. The cover of the present invention is unique over all previous attempts to cover a musical string in that the cover is selected and applied so as not to significantly degrade the normal sound of the musical instrument. The cover therefore is substantially a non-dampening cover.

The cover of the present invention is applied so as to provide a lubricious covering, and to protect the string from contamination and corrosion with little or no interference of the free movement of the wound string. Preferably, an expanded PTFE is employed that is longitudinally stretched so as to be relatively nondeformable in its longitudinal direction and relatively deformable in its transverse direction. By wrapping this cover around the wound string with the longitudinal axis of the cover oriented at an angle to the longitudinal axis of the wound string, the cover will maintain its position and conform to the wound string but will still permit sufficient movement of the windings to maintain tonal quality.

If an adhesive is applied to hold the cover to the wound string, bonding should be accomplished to assure that winding movement is not diminished. For example, a discontinuous coating of adhesive will provide secure attachment of the covering to the winding without interfering with the vibration of the wound strings.

The performance of the string of the present invention can be further enhanced by applying an additional layer of material on the outside of the expanded PTFE covering, such as a fluorinated ethylene propylene (FEP) polymer. This additional layer is believed to provide a number of important benefits, including better adhesion of the cover layer to itself, and improved resistance to wear and contamination. Additionally, it has been observed that an outside layer of such material may actually improve tonal quality of the string over use of a cover without such a layer.

While contamination resistance and improved string life are important benefits of the present invention, increased finger comfort or "playability" is an equally exciting advantage. The string of the present invention is much more comfortable to use than conventional strings without covers. This results in the ability of a musician to play longer and with less fatigue. Moreover, since a fluoropolymer cover, such as PTFE, or FEP or a composite of these materials, is extremely smooth and slippery, the strings of the present invention are far less prone to "squeaking" during fingering. This allows for faster and less tiring fingering techniques without generating unwanted noise. This is also believed to make the guitar easier to learn and master by beginning players.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved string for use with a variety of musical instruments employing strings. It is contemplated that the string of the present invention may be useful in many different types of musical instruments, such as but not limited to guitars, double basses, pianos, violins, cellos, etc.

Figure 1:
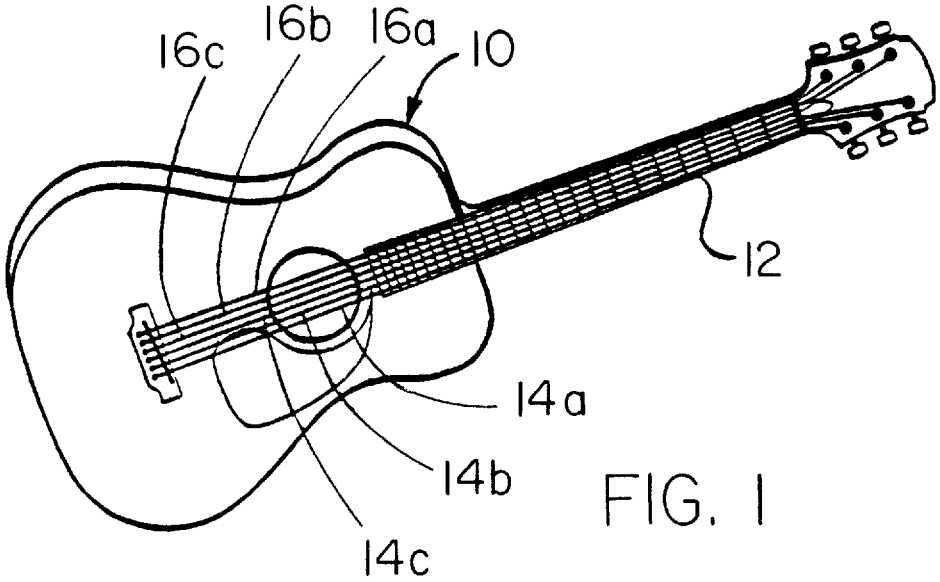
FIG. 1 is a three-quarter perspective view of a guitar having strings of the present invention.

FIG. 1 illustrates a conventional six string guitar 10, one such musical instrument that can benefit from employing the strings of the present invention. All conventional guitars include a "fret" or "fingering board" 12, across which multiple strings, 14*a*, 14*b*, 14*c*, 16*a*, 16*b*, and 16*c*, are strung and against which the strings are pressed to form different notes. A typical six string guitar includes three relatively "high" note strings, 14*a*, 14*b*, 14*c*, and three relatively "low" note (or "bass") strings, 16*a*, 16*b*, 16*c*. High note strings 14 are generally formed from a straight "non-wound" material, such as "catgut," metal, or polymer. In order to achieve significantly lower notes without increasing the length of the string or unduly increasing its thickness, low note strings 16 generally employ a wound string construction.

Figure 2:
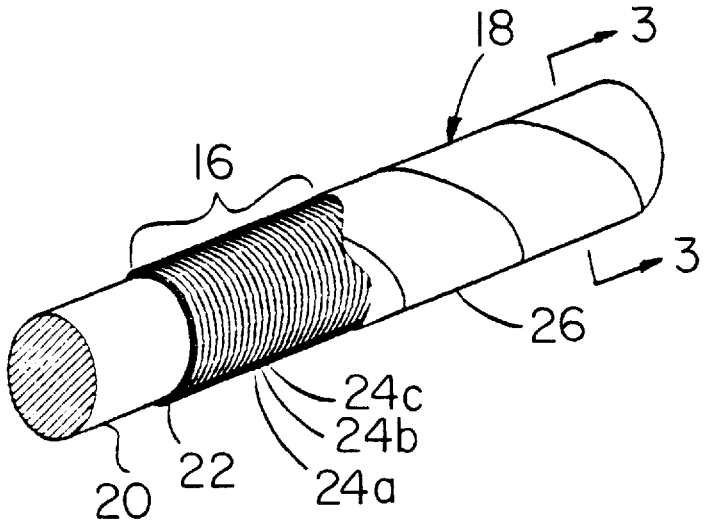
FIG. 2 is a three-quarter isometric view, partially in cut-away, of one embodiment of a string of the present invention.
Figure 3:
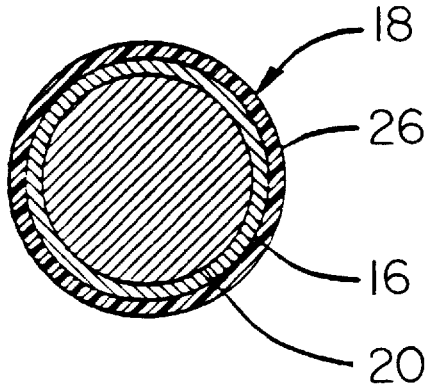
FIG. 3 is an enlarged transverse cross-section view along line 3–3 of FIG. 2, with the cover shown enlarged for detail.

The form of a typical wound string 16 (e.g., a guitar bass string) can be seen inside the string 18 of the present invention illustrated in FIGS. 2 and 3. As is shown, wound strings 16 employ a core 20, such as a straight gauge metal, catgut or polymer, and a winding 22 (e.g., metal or polymer) wrapped repeatedly around the core 20. The winding 22 is held in place around the core by tension and the anchoring of it at its ends.

When a conventional wound string 16 is played for a period of time, it tends to lose its tonal quality due to "contamination" of the string. It is believed that proper tonal quality of a wound string 16 is dependent upon allowing movement between individual wraps 24*a*, 24*b*, 24*c*, etc., of the winding 22 during play. Contamination in the form of dirt, oil, sweat, etc., tends to become entrapped within the winding 22, causing limited motion of the individual wraps 24. This is a particular problem on a finger board of an instrument because of the constant handling of the strings in that area. As a result, after a relatively short period of play, wound strings begin to diminish in tonal quality. Professional musicians who care about tonal quality are then often required to remove and replace or clean the wound strings on a regular basis to maintain proper sound.

In order to address this problem, the present invention wraps the wound string 16 with a cover 26 along at least a portion of its length. The cover 26 of the present invention serves to seal the winding 22 of the string from contamination during handling, while avoiding the problem of restricting movement of the individual wraps 24.

The form of the cover 26 is believed to be quite important in the operation of the present invention. Although a wound string 16 may theoretically be wrapped with virtually any material to reduce contamination, there are a number of important considerations in choosing an appropriate cover. The foremost problem with encasing the strings in some covering is that many covering materials tend to deaden the sound of the strings. This result is to be expected when a string vibrates somewhat out of phase with a cover, which will naturally reduce the amount and duration of the vibration of the string. A cover that is not adhered to the strings, such as that employed with the Fender Corporation wrapped bass strings, has been shown to produce a particularly "dead" sound. However, adhering and conforming a cover to the strings may tend to restrict the movement between the individual wraps 24 of the winding. This may also be expected to deaden the sound, much in the same way as contamination does.

Another problem with any string cover is that the cover must be capable of withstanding substantial wear and abrasion during use. While adhesion of the cover to the underlying string may reduce abrasion between the cover and the string during use, as has been noted, such adhesion may also restrict the vibration of the string.

The present invention solves the problem of string contamination with minimal diminishing of the lively sound of the string. This is accomplished by wrapping at least a portion of the string with a polymer cover that is deformable enough to allow movement of the wraps of the winding during play. Preferably, the cover is formed from a material that is deformable enough to permit relatively free movement of the wraps 24 even when the cover is at least partially adhered to the winding. Further, it is important that the cover be sufficiently durable to withstand the abrasion occasioned by playing of the string.

As the term "deformable" is used herein, it is intended to include any process or state whereby a covering material alters its shape under the normal pressures and stresses encountered by a musical instrument string. It is particularly preferable that a deformable cover used in the present invention allows for the normal movement of string windings along the longitudinal axis of the string while including at least some recovery (that is, elasticity) so that the cover tends to return to its original shape upon removal of the pressure or stress. The cover of the present invention should be sufficiently deformable along the length of the string so as to maintain the tonal quality of the string.

Materials suitable for use as a cover of the present invention include, but are not limited to, the following: polytetrafluoroethylene (PTFE) including porous PTFE and particularly including porous expanded PTFE (ePTFE); fluorinated ethylene propylene (FEP); polyethylene including ultrahigh molecular weight polyethylene; perfluoro alkoxy resin (PFA); polyurethane; polypropylene; polyester; polyimide and polyamide.

The preferred string cover of the present invention comprises a porous polymer material such as uniaxially expanded polytetrafluoroethylene. This material has demonstrated exceptional durability with properties that maintain excellent tonal qualities for the covered string. Porous expanded PTFE, such as that made in accordance with U.S. Pat. Nos. 3,953,566; 3,962,153; 4,096,227 and 4,187,390, all incorporated by reference, comprises a porous network of polymeric nodes and interconnecting fibrils. This material is commercially available in a variety of forms from W. L. Gore & Associates, Inc., Newark, Del.

Expanded PTFE is formed when PTFE is heated and rapidly expanded by stretching in at least one direction in the manner described in the above listed patents. The resulting expanded PTFE material achieves a number of exceptional properties, including exceptional strength in the direction of expansion, and exceptionally high flexibility, and conformability. Interestingly, although expanded PTFE material is quite strong and relatively non-deformable in the direction of expansion, the oriented characteristics of the fibrillar microstructure make the material relatively deformable and easily distorted in a direction other than the direction of stretch. As is known, the amount of strength and deformability of the expanded PTFE can be adjusted by varying the expansion procedures, providing a wide degree of strength, porosity, and deformability in different directions by changing the direction and amount of expansion.

As the term "expanded PTFE" is used herein, it is intended to include any PTFE material having a node and fibril structure, including in the range from a slightly expanded structure having fibrils extending from relatively large nodes of polymeric material, to an extremely expanded structure having fibrils that merely intersect with one another at nodal points. The fibrillar character of the structure is identified by microscopy. While the nodes may easily be identified for some structures, many extremely expanded structures consist almost exclusively of fibrils with nodes appearing only as the intersection point of fibrils.

The preferred expanded PTFE cover for use with most wound strings is one with above about 50% porosity.

For use on a conventional guitar, it is believed to be important for the string to be covered only along the fret board, where the strings undergo the greatest amount of handling. By leaving the string uncovered in the region where the string is strummed, the life of the string of the present invention is believed to be prolonged since the cover will not be exposed to harsh wear from a pick, fingernails, etc., imparted during the process of play. It should be understood, however, that suitable strings of the present invention may include covers extending over the strumming region of the string. In fact, such a construction may be beneficial under certain conditions, such as when the strings are being played with fingers alone. Additionally, with other instruments such as piano strings, etc., it may be preferred to cover the entire string in accordance with the present invention.

There are a number of ways that the string of the present invention may be even further improved. First, while the cover of the present invention may be applied with the tension of a helical wrap (such as the wrap of the cover 26 shown in FIG. 2) alone keeping it attached to the string, it is believed preferred to employ some form of adhesive on the cover before it is applied to the string, and/or a coating over the cover to help retain the cover to the string. In choosing an adhesive, it is very important to keep in mind that an adhesive applied under the cover may have the undesirable effect of adhering the windings of the string together, thereby limiting the vibration of the string.

Figure 4:
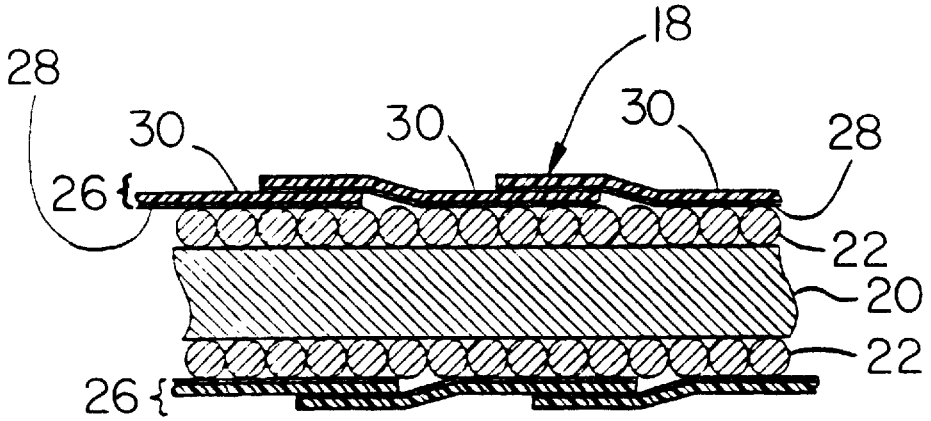
FIG. 4 is an enlarged longitudinal cross-section view of a portion of the cover of the string of FIGS. 2 and 3.

One method of attaching the cover 26 to the winding 22 is by using a continuous or discontinuous coating of adhesive. As is shown in FIG. 4, by applying adhesive coating 28 to a polymer layer 30, sufficient adhesion can be provided without introducing enough adhesive to seep within the winding 22. In this manner, the adhesive will not interfere with the normal movement between the windings.

A number of different adhesives may be employed in the present invention. The adhesives can be thermoplastic, thermosetting, or reaction curing types, in liquid or solid form, selected from the classes including, but not limited to, polyamides, polyacrylamides, polyesters, polyolefins (e.g., polyethylene), polyurethanes, and the like. Particular adhesives that may be employed in the present invention include polyurethane, FEP, or PFA. Suitable application means include gravure printing, spray coating, powder coating, and the like.

The preferred polymer cover is expanded PTFE, and the preferred adhesive coatings are thermoplastics of lower melt point than the crystalline melt point of the PTFE. Thermoplastic adhesives such as FEP are most preferred.

Coated porous expanded PTFE film can be made by a process which comprises the steps of:

a) contacting one surface of a porous PTFE substrate, usually in the form of a membrane or film, with another layer which is preferably a film of FEP or alternatively of another thermoplastic polymer;

b) heating the composition obtained in step a) to a temperature above the melting point of the thermoplastic polymer;

c) stretching the heated composition of step b) while maintaining the temperature above the melting point of the thermoplastic polymer; and d) cooling the product of step c).

In addition to FEP, other thermoplastic polymers including thermoplastic fluoropolymers may also be used to make this coated film. The adhesive coating on the porous expanded PTFE film may be either continuous (i.e., covering virtually all of the surface pores of the porous PTFE and rendering the cover essentially non-porous) or discontinuous (i.e., leaving some of the surface uncovered, thereby maintaining some degree of cover porosity through the coated film) depending primarily on the amount and rate of stretching, the temperature during stretching, and the thickness of the adhesive prior to stretching.

The cover of the present invention may be applied in a variety of manners while maintaining the benefits of the present invention. In the preferred helical wrapping of the cover described above, the cover may also be wrapped longitudinally (in a "cigarette wrap" manner), or as a continuous and seamless tube surrounding the string. Regardless of the type of covering procedure, it is believed important that the cover remains deformable in the longitudinal axis of the string. Multiple layers may also be applied.

Figure 5:
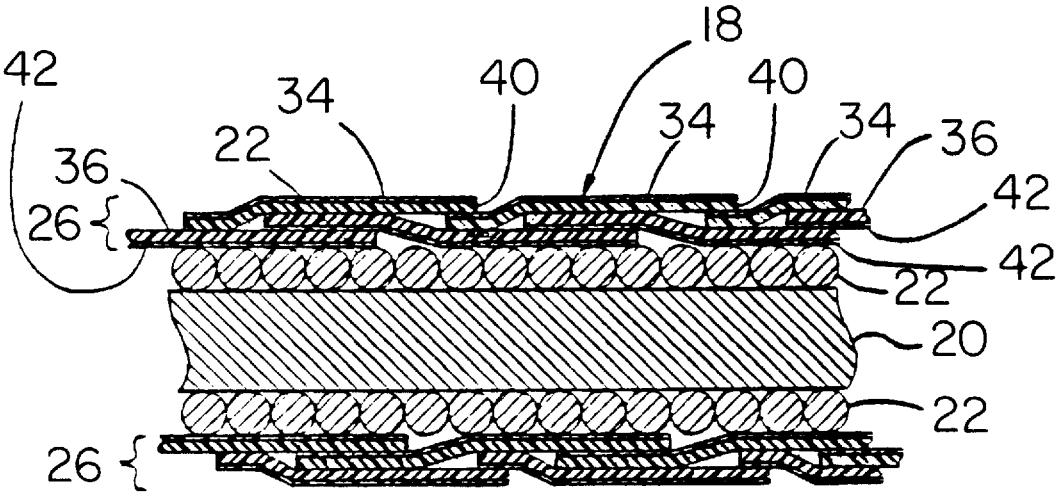
FIG. 5 is an enlarged longitudinal cross-section of a portion of the cover of a second embodiment of a string of the present invention.

It should be appreciated that the cover of the present invention may be formed through a number of different constructions. FIG. 5 illustrates a cover 26 that employs an outer coating 34, a first polymer layer 36, a second polymer layer 40, and a continuous or discontinuous adhesive layer 42 adhered to first polymer layer 36. This construction provides a thicker and more durable cover 26. Additionally, by providing multiple polymer layers 36, 40, the deformable and strength properties of the cover can be further optimized.

Figure 6:
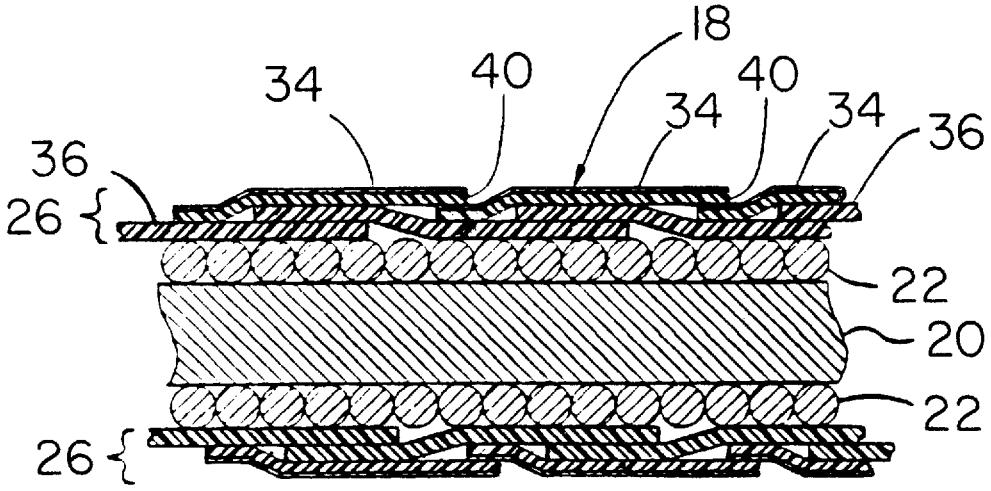
FIG. 6 is an enlarged longitudinal cross-section of a portion of the cover of a third embodiment of a string of the present invention.

It is most preferred to provide at least two polymer layers of expanded PTFE, each having been stretched in a longitudinal direction, with each of the expanded PTFE layers wrapped at different angles to each other. This is accomplished by two sequential helical wrappings applied over the instrument string at approximately equal but opposite pitch angles which are measured respectively from opposite ends of the longitudinal axis of the string; i.e., the pitch angles of the first and second wrappings are measured from opposite ends of the string. This construction is believed to provide excellent strength and durability while maintaining good deformability along the length of the string. Still another embodiment of the present invention is shown in FIG. 6. In this instance, the cover 26 comprises an outer coating 34, a first polymer layer 36, and a second polymer layer 40 over winding 22. While the polymer layer 36 may be attached to the winding 22 with some form of adhesive, it is believed that a tight wrap of the polymer cover layers 36 & 40 may be adequately secured by the outer coating 34.

Figure 7:
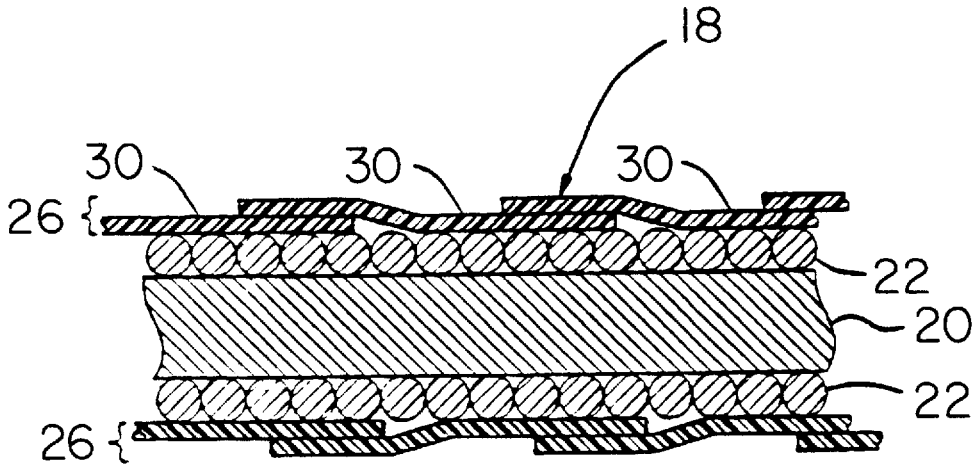
FIG. 7 is an enlarged longitudinal cross-section of a fourth embodiment of a string of the present invention.

A further example of the present invention is shown in FIG. 7. In this embodiment, winding 22 is provided with a cover 26 in the form of a wrapped polymer layer 30 having overlapping edges and thereby forming a continuous cover. The polymer layer may optionally be heated to thermally bond the overlapped edges together. The cover 26 may or may not include an adhesive coating on its outwardly facing surface, such as a coating of FEP polymer. The adhesive coating serves to adhere the wraps together and also provides an additional protective layer to shield the cover from wear and contamination.

Figure 8:
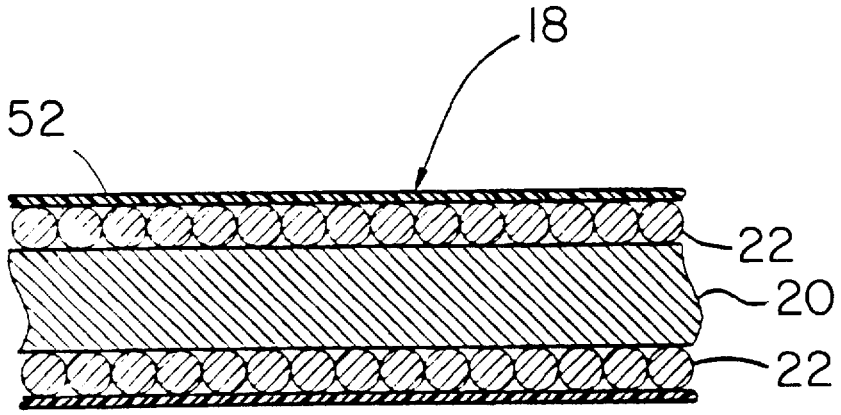
FIG. 8 is an enlarged longitudinal cross-section of a fifth embodiment of a string of the present invention.

Yet another embodiment of the present invention is shown in FIG. 8. In this embodiment, windings 22 are protected within a continuous and seamless polymer cover 52. The preferred continuous and seamless cover comprises a sleeve of polymer material (such as a thin, extruded sleeve of expanded PTFE, FEP, PFA or the like). While the sleeve cover 52 may be adhered in place, it may be desirable to provide a sleeve of PTFE or other shrinkable material that can be shrunk by heat or tension around the winding 22. Again, it is believed that the cover 52 should be sufficiently deformable along its longitudinal axis to permit relatively free movement of the windings.

In addition to protecting the strings of the present invention from contamination, it has been determined that the cover of the present invention also makes the strings easier to play. The cover provides some cushioning of the strings and provides a layer of protection from the friction of conventional strings against a musician's fingers. The result is a string that is much easier to play for longer periods of time without discomfort and with less fatigue.

Another important advantage of the strings of the present invention is that they experience significantly less unwanted noise when played. It has been shown that the familiar "squeak" that occasionally occurs when conventional wound strings are rapidly fingered along their length can be diminished or eliminated using the strings of the present invention. The inventive string therefore should allow faster and easier fingering techniques without unwanted noise and with greatly reduced fatigue. It is believed that the elimination of the extraneous "squeak" noise of guitar or other musical instrument strings without diminishing the tonal quality of the strings may result in one of the most important benefits of the present invention.

It should be noted that some of the beneficial results of the present invention may be realized by employing an adhered polymer coating alone as a cover. Suitable polymers for this application may include PTFE dispersion, polyurethane, FEP, PFA, or the like. A PTFE dispersion can be coated on the string and then baked in place. Polymers such as polyurethane, FEP, PFA, etc., will adhere to the string and may be employed as adhesives or further processed to improve adhesion or durability.

Figure 9:
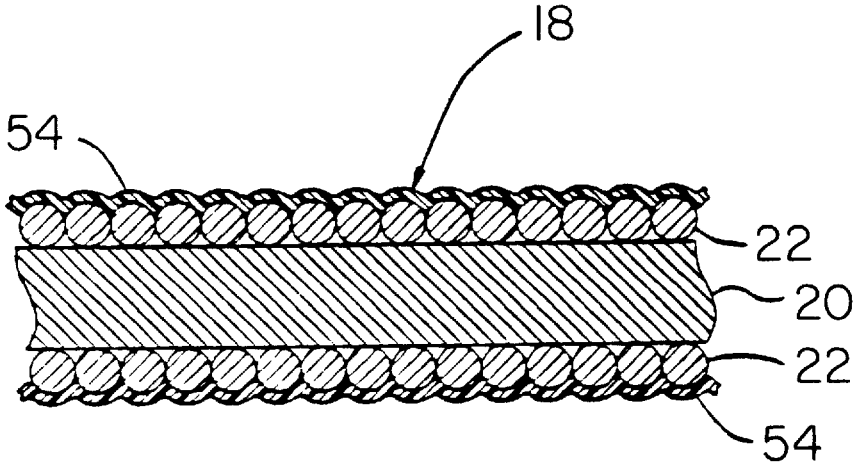
FIG. 9 is an enlarged longitudinal cross-section of a coating provided as a covering for wound strings.
Figure 10:
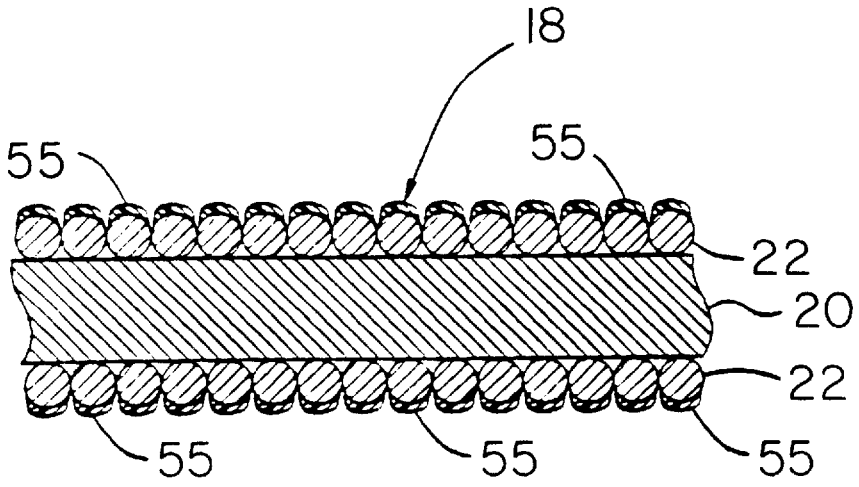
FIG. 10 is an enlarged longitudinal cross-section of a coating provided as a covering for wound strings.

FIGS. 9 and 10 illustrate two embodiments of such coatings applied to wound strings. FIG. 9 shows an enlarged longitudinal cross section of an embodiment wherein coating 54 provides a continuous covering of the wound string in that the coating 54 spans adjacent windings without helical abutted seams 22. Alternatively, as shown by the enlarged longitudinal cross section of FIG. 10, coating 55 may provide a polymeric covering that does not span between adjacent individual windings 22. In this instance, it is preferred that the discontinuous coating 55 on each winding 22 closely abuts the adjacent discontinuous coating 55 so as to limit penetration of contamination between the windings.

Polymeric coverings may also be provided for straight (non-wound) strings as well as for wound strings. Such a covering on a straight string provides increased lubricity and protection from corrosion and consequently allows faster and more comfortable playing. The covering may be provided along only a portion of the length of a string if desired. For example, the covering may be provided only along the fret board portion of a guitar string.

Figure 11:
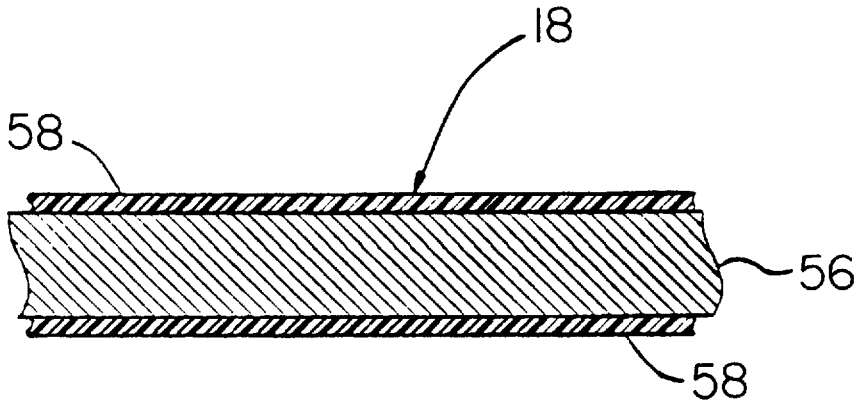
FIG. 11 is an enlarged longitudinal cross-section of a covering for straight musical instrument strings.
Figure 12:
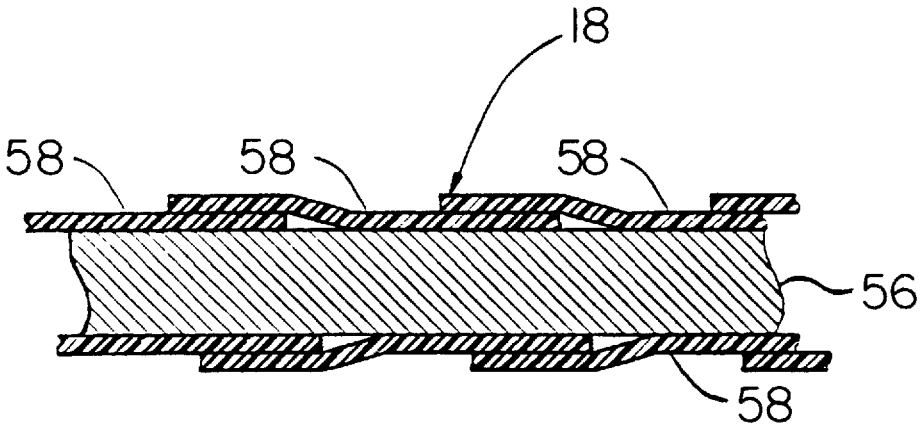
FIG. 12 is an enlarged longitudinal cross-section of a covering for straight musical instrument strings.
Figure 13:
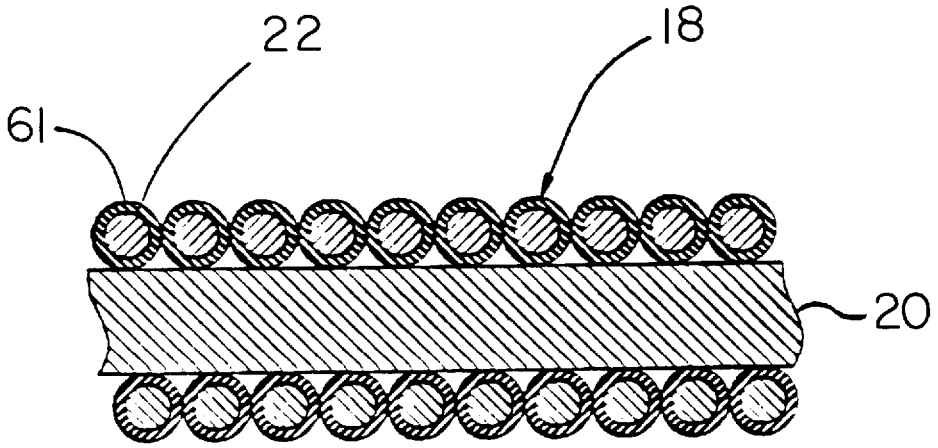
FIG. 13 is an enlarged longitudinal cross-section of a covering for the windings of the wound string.

FIG. 11 shows an enlarged longitudinal cross section of a straight string 56 provided with a continuous and seamless covering 58 over at least a portion of the length of string 56. Covering 58 may take the form of a continuous and seamless tube, such as a length of heat shrink tubing fitted over string 56, or may take the form of a coating of the types described previously adhered to the surface of string 56. As shown by the enlarged longitudinal cross section of FIG. 12, covering 58 over straight string 56 may also take the form of a polymeric film helically wrapped around the string 56 so as to have overlapping edges, thereby forming a continuous covering. Such a film covering may or may not be adhered to the surface of the string 56. Appropriate films for use in this embodiment are of the types described previously as coverings for wound strings. FIG. 13 illustrates still another embodiment of the invention where in the covering 61 is applied to the winding 22 prior to being wound onto the core 20. This covering may also be in the form of a coating.

One of the additional benefits that may be experienced with the present invention is improved shelf life of the strings. Musical instrument strings often begin to degrade while being stored before they are even installed. The primary problem in this regard is believed to be oxidation that attacks both wound and unwound strings while they are stored in their original packaging. The cover of the present invention can serve to seal the strings from air and moisture, thus reducing or eliminating this problem. It is contemplated within the scope of the present invention to provide a cover along the entire length of the strings in their original packaging to further protect against such contamination problems. The strings can then be used with the entire string covered or scoring can be provided to allow unwanted portion of the covering to be removed from the string (e.g., stripped) before they are played.

Without intending to limit the scope of the present invention, the following examples illustrate how the present invention may be made and used:

Example 1

Figure 14:
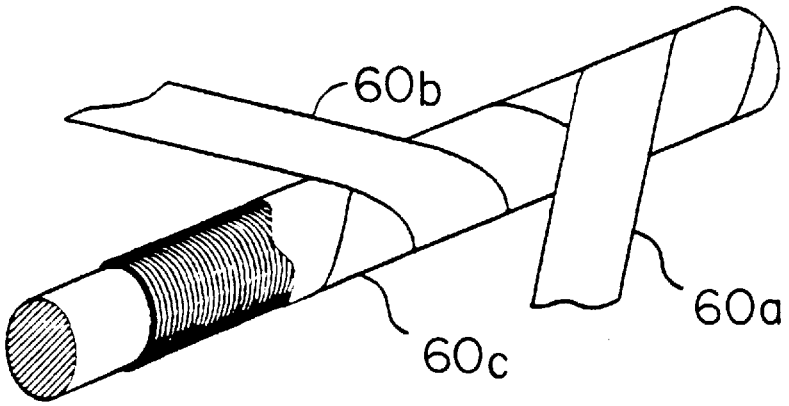
FIG. 14 is a three-quarter isometric view, partially in cutaway, of another embodiment of a string of the present invention, in this instance employing a wrap of three (3) opposing layers.

This Example was made from a purchased FENDER 150SXL nickel wound guitar strings 0.61 mm (0.024 in.), 0.81 mm (0.032 in.), and 1.067 mm (0.042 in.) diameters. The covering was two types of ePTFE film, one type provided with a continuous coating of FEP adhesive on one surface and one with a discontinuous coating of FEP on one surface. Both types of ePTFE film had average fibril length of about 50 microns and a bulk density of about 0.35 g/cc. Average fibril length was estimated from scanning electron micrographs of the surface of the ePTFE film. The film with a continuous coating of FEP was 0.025 mm (0.001 in.) thick. The film with a discontinuous coating of FEP was 0.015 mm (0.0006 in.) thick. As is shown on FIG. 14, the wrap configuration was a bias wrapping of three (3) 6.35 mm (¼ in.) wide composite film tapes 60*a*, 60*b*, 60*c* placed in alternating layers with each layer applied in a different direction. The tapes were wrapped with approximately 50% overlap at approximately 300° from perpendicular to the string longitudinal axis. The first layer was ePTFE with a continuous FEP coating facing down on the wire; the second layer was ePTFE with a discontinuous FEP coating facing up away from the wire; and a third layer was ePTFE with a continuous FEP coating facing up away from the wire.

The string was placed under tension and heated to 345° C. in a convection oven set at 375° C. The string was removed from the oven when the surface of the string reached 345° C. as determined by a thermocouple attached to the exposed metal surface of the string and monitored by a readout.

Example 2

This example was made from a purchased FENDER 150SXL nickel guitar string 1.067 mm (0.042 in.) diameter. The cover was ePTFE film with no adhesive and approximately 0.010 mm ( 0.0004 in.) thick. The ePTFE film had an average fibril length of about 70 microns and a bulk density of 0.30 g/cc. The tape and wrap configuration was a bias wrap as in Example 1 except that only two alternating layers were applied in opposing directions. The string was heated as described in Example 1.

Example 3

This example was made from purchased ERNIE BALL nickel wound 0.61 mm (0.024 in.) and 1.067 mm (0.042 in.) diameter guitar strings. The strings were covered with a continuous length of TFE shrink tubing from Zeus Industrial Products, Inc., of Raritan, N.J. The coverings were shrunk around the strings by heating the strings to 327° C in an oven set at 375° C as determined by a thermocouple and temperature readout as in previous examples. Covers were as follows:

| Guitar String Dia. | Shrink Tube Cover |
|---|---|
| 0.61 mm (.024 in.) | .76 mm (.030 in) to .31 mm (.012 in.) dia × .08 mm (.003 in) wall thickness |
| 1.067 mm (.042 in.) | 1.17 mm (.046 in) to .56 mm (.022 in.) dia × .05 mm (.002 in) wall thickness |

Example 4

This example was made from a purchased ERNIE BALL nickel wound string 0.81 mm (0.032 in.) diameter. This string was covered with a ZEUS 1.17 mm to 0.56 mm (0.046 in. to 0.022 in.) TFE shrink tube as in Example 3. The string was tested and the performance recorded before the shrink tube was heated and conformed to the wire.

Example 5

This example was made from a purchased FENDER 150SXL 1.067 mm (0.042 in.) nickel wound guitar string. The string was helically tape-wrapped (one layer and one direction) with 3M Scotch 35 vinyl plastic electrical tape (available from 3M, Hutchinson, Minn.) with the adhesive against the wound wire. The tape was slit into 6.35 mm (¼ in.) width and applied as in other examples. No heating was performed.

Example 6

This example was made from a purchased FENDER guitar string 150SXL 1.067 mm (0.042 in.) diameter. The string was covered with porous ultra high molecular weight polyethylene approximately 0.006 in. thick. The process involved helically tape-wrapping as in other examples. The film was applied in one layer and in one direction with approximately 50% overlap. The string was then heated in the convection oven set at 200° C. and removed when the wire string reached 175° C. as determined by a thermocouple and readout as in other examples.

Example 7

A series of sample strings were made using a purchased FENDER bass guitar string #2200 2.33 mm (0.092 in.) diameter provided by Fender with a wrapping of polyamide (nylon flat tape having abutted edges). The tape measured approximately 0.97 mm (0.038 in.) wide and approximately 0.33 mm (0.013 in.) thick).

To conduct a comparative test, four test samples were made using the same string. The samples were constructed as follows:

Sample 1: the FENDER string as received in the commercial package.

Sample 2: the FENDER string of Sample 1 was stripped of the nylon cover and tested as a bare metal wire wound string.

Sample 3: the string of Sample 2 was covered with the two types of ePTFE films as used in Example 1. Four total layers in alternating directions were applied to the string:

Layer 1: ePTFE film with continuous coating of FEP; FEP oriented down on the wire.

Layer 2: ePTFE film with discontinuous coating of FEP; FEP oriented up away from wire.

Layer 3: ePTFE with discontinuous coating of FEP; FEP side oriented down on the first two layers.

Layer 4: ePTFE with continuous FEP coating; FEP facing up away from wire.

The covered string was heated as described in Example 1.

Sample 4: the string used in the previous three samples was used again but with the addition of two layers of the ePTFE film described in the previous sample;

Layer 5: ePTFE film with continuous FEP coating; FEP oriented down on wire.

Layer 6: ePTFE film with continuous FEP coating; FEP oriented up away from wire.

Again the string was heated as described in Example 1.

Testing

Guitar strings from Examples 1–6 described above and comparable uncovered control strings were individually installed and tested on a PEAVY PREDATOR electric guitar. The string of Example 7 was installed and tested on a FENDER Jazz Electric Bass Guitar. The pickup of each guitar was amplified by using an ENVOY 110 amplifier. An HP 35670A dynamic signal analyzer was then connected to the amplifier output jack to both monitor and capture signal output. A fixture with a spring loaded mechanical arm was employed to create a consistent deflection of each string tested.

The control strings were strings as purchased from the manufacturer which were compared to the inventive covered strings of the same type and size. The comparative data in Table 1 describe the difference of the amplitude of a sound produced by the control string versus the comparable inventive covered string for various harmonics, based on equal amplitude signals from both strings at the fundamental harmonic. The data in Table 1 appear only where the dB difference was greater than 2 dB. A positive value indicates a larger amplitude for the covered inventive string than for the comparable control string while a negative value indicates the opposite result. The example types are described at the beginning of each numbered row of Table 1.

The same comparison was made of a Fender Bass guitar string #2200 as described in Example 7 with additional comparisons for the final (eighth) ¼-second of the two second period. These additional data are described in Table 2. This final ¼-second is believed to be particularly important on a bass guitar since it is generally desired for bass notes to be sustained during play.

Analysis of the harmonic content and spectral shape of an acoustic wave is a complex problem. The conventional oscilloscope displays a signal in the time domain which represents the amplitude or intensity as a function of time. The amplitude at any instant of time is a result of the superposition of all the amplitudes of all harmonics present. The resulting waveform is a complex, time varying signal. Using a Dynamic Signal Analyzer (DSA) the information content of the recorded signal may be transformed using the Fast Fourier Transform (FFT) from the time domain to the frequency domain. The resulting display depicts the amplitude or intensity at each frequency, effectively decomposing the signal into its components. For the analysis described in this document, a Hewlett-Packard model 35670A DSA, serial number 3340-A00485 was used. This analyzer is basically a digital sampling, storage oscilloscope with a built in microprocessor and software which performs the FFT on the signal and displays the result on a CRT or stores the result on a floppy disk for postprocessing analysis.

Figure 15:
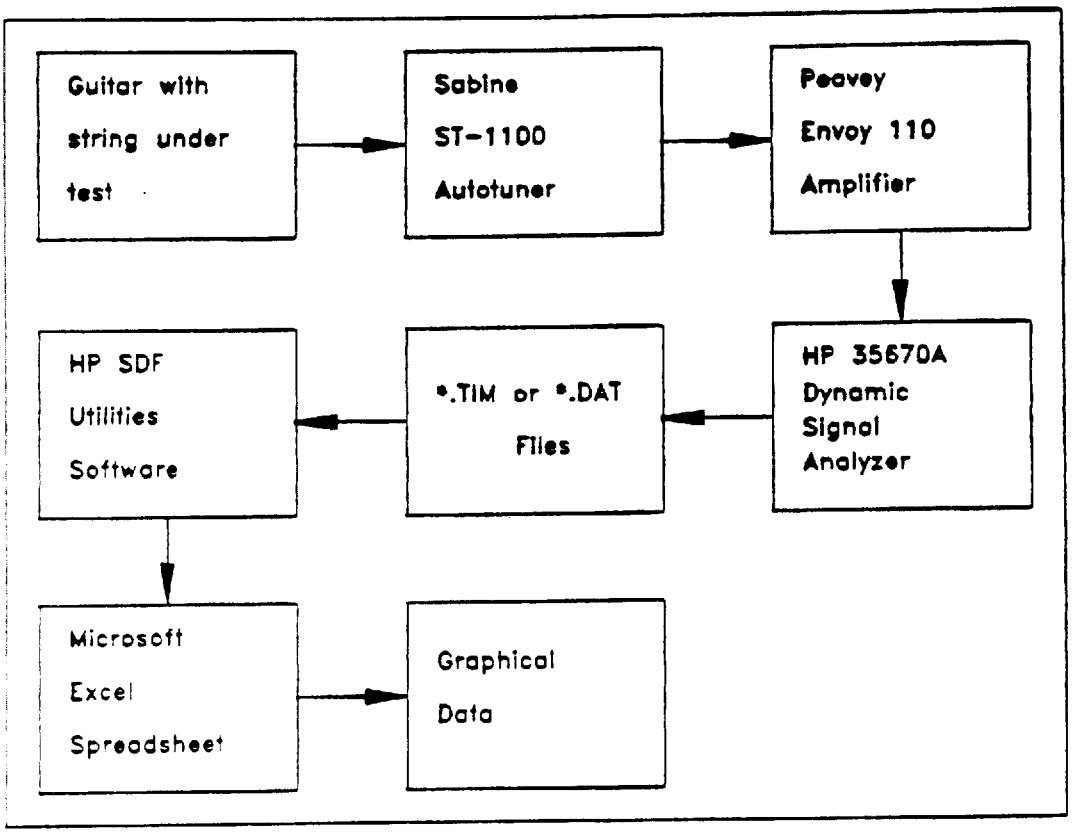
FIG. 15 is a schematic depiction of sound evaluation equipment.

An electric guitar body was provided with an electric guitar pickup that directly sensed the string vibration. The fixture with the spring activated mechanical arm was attached to the guitar. A PINK PEARL brand rubber eraser was substituted for a conventional plastic guitar pick to reduce variable noise effects. The analysis equipment is depicted schematically in FIG. 15.

To perform a sound measurement, the string under test was mounted on the guitar body, tuned to the correct pitch using the SABINE ST-1100 Autotuner, and deflected once with the PINK PEARL eraser attached to the test fixture. The DSA was configured to capture the first two seconds of the signal. The analyzer time capture was triggered to begin with the onset of the signal. The analyzer bandwidth was set to 1,600 Hz since there were no significant harmonics present in any of the strings tested beyond the tenth for the highest pitch string (D at a 146.83 Hz fundamental). This resulted in eight (8) blocks of data, each ¼-second long, being recorded with 1024 individual samples per block. The FFT was performed on the stored signal with a resulting frequency resolution of 4 Hz.

The record for the two-second time capture was stored as an HP SDF format data file which is the native data format for the DSA. The FFT traces for the first and last blocks of the eight block capture were also stored. The HP supplied program "Viewdata" was used to examine each stored FFT trace. The peak amplitude of the signal at each harmonic and its corresponding frequency were recorded and input to a MICROSOFT "Excel" spreadsheet program for plotting purposes. The data for each covered string were compared to the corresponding control string without a covering by using equal amplitude signals at the fundamental frequency and then taking the difference between the covered and control strings at each higher harmonic. The first ¼-second is believed to be the most relevant for analysis since most guitar music is played with a fairly rapid tempo. The bass guitar string was also analyzed at the final eighth ¼-second block since they are usually played with a longer sustained note. The following subjective conclusions were drawn from this testing:

On A and E strings, the 3 wrap ePTFE results in uniformly higher intensity higher harmonics; on a D string some harmonics were enhanced while others were attenuated.

On E strings, ePTFE applied without adhesive and the TFE shrink tube had broadly higher intensities at higher harmonics. Both vinyl electrical tape and porous UHMWPE had some harmonics enhanced and some attenuated.

The application of loosely applied heat-shrink TFE tubing to an A string results in reduced harmonic content. However, when shrunken as in Example 3 on the E and D string, there is greater intensity in harmonic content across most frequencies.

On the FENDER bass A string, the meaningful comparison is believed to be at the last time frame tested since bass notes tend to be sustained during play. The data were gathered in eight ¼-second blocks, and the comparisons at the eighth block are significant. The non-deformable nylon tape wrapping of the Fender bass guitar string attenuated the harmonic content for all harmonics. The ePTFE covering resulted in increased harmonic intensity for nearly all frequencies.

The presence of a covering alters the harmonic content of the vibrations of a wound vibrating string. When the covering is ePTFE, with or without an adhesive, the resulting covered string vibrates with more energy in the higher harmonics or overtones when compared to a string without a covering tuned to the same pitch. While pronounced increases in harmonic intensity were noted, some specific frequencies were attenuated below those of the controls for some constructions.

Human hearing, which peaks in sensitivity at around 3 kHz, is thus particularly sensitive to higher harmonics of these generally low pitched strings. The subjective interpretation of greater intensity in higher harmonics is that the sound appears "brighter" or "fuller" for the inventive strings, even though one or more specific higher frequencies may be slightly attenuated when compared to the control string without a covering.

In all cases of the covered strings of the present invention, musicians experienced less friction while fingering the strings than would be encountered with conventional strings without covers. This allowed for far more comfortable play over a longer period of time. With prolonged playing of the inventive strings over a period of weeks, it was observed that calluses that form on the musician's fingering hand actually diminished (probably from the reduced abrasion encountered with the inventive strings).

Another significant improvement observed was that extraneous noise ("squeak") from playing the inventive strings virtually disappeared as compared to conventional strings without covers. This allowed for faster fingering techniques without "squeaking" during note changes, greater comfort, and less playing fatigue since fingers do not have to completely separate from the strings when changing position.

Since the degree of enhancement or attenuation of string sound was observed to vary using different types of covers on different types of strings, it may be beneficial to employ different polymeric covers on different string types in a set of strings in order to mix and match sound qualities.

While particular embodiments of the present invention have been illustrated and described herein, the present invention should not be limited to such illustrations and descriptions. It should be apparent that changes and modifications may be incorporated and embodied as part of the present invention within the scope of the following claims.

TABLE 1

| | | First ¼-Second Response (of Eight ¼-sec. intervals recorded) | | | | | |
|---|---|---|---|---|---|---|---|
| | | Column A D string (148 Hz) | | Column B A string (108 Hz) | | Column C E string (84 Hz) | |
| Example # | Construction | Harmonic | Intensity dB | Harmonic | Intensity dB | Harmonic | Intensity dB |
| 1 | 3 wrap ePTFE | 5 | +7 | 8 | +9 | 4 | +3 |
| | | 6 | −4 | 9 | +7 | 9 | +4 |
| | | 8 | +6 | | none < 0 | | none < 0 |
| | | 9 | −5 | | | | |
| 2 | ePTFE no adhesive | N/A | | N/A | | 5 | +10 |
| | | | | | | 8 | +13 |
| | | | | | | 12 | +10 |
| 3 | TFE shrink tube (Zeus) | 3 | +5 | N/A | | 5 | +22 |
| | | 4 | +11 | | | 7 | +21 |
| | | 5 | +13 | | | 8 | +11 |
| | | 8 | −3 | | | 11 | +11 |
| | | 9 | +5 | | | | none < 0 |
| | | 10 | +11 | | | | |
| 4 | TFE tube (loose | N/A | | 7 | −32 | N/A | |
| | | | | 8 | −42 | | |
| | | | | 9 | −40 | | |
| 5 | Vinyl electrical tape | N/A | | N/A | | 5 | +11 |
| | | | | | | 6 | −34 |
| | | | | | | 8 | +7 |
| | | | | | | 9 | −8 |
| 6 | Porous UHMWPE | N/A | | N/A | | 5 | +4 |
| | | | | | | 6 | −7 |
| | | | | | | 8 | +10 |
| | | | | | | 9 | −4 |

TABLE 1-continued

| | | First ¼-Second Response (of Eight ¼-sec. intervals recorded) | | | | | |
|---|---|---|---|---|---|---|---|
| | | Column A D string (148 Hz) | | Column B A string (108 Hz) | | Column C E string (84 Hz) | |
| Example # | Construction | Harmonic | Intensity dB | Harmonic | Intensity dB | Harmonic | Intensity dB |
| 7 (Sample 1) | Fender Bass A String nylon wound (commercially available product) | N/A | | 12<br>13 | −6<br>−6<br>none > 0 | N/A | |
| 7 (Sample 3) | Fender Bass A String 4 wrap ePTFE | N/A | | 4<br>7<br>9<br>11<br>14 | +4<br>+5<br>−3<br>+7<br>+4 | N/A | |
| 7 (Sample 4) | Fender Bass A String 6 wrap ePTFE | N/A | | 7<br>9<br>11<br>13 | +4<br>−4<br>+6<br>+4 | N/A | |

N/A = not applicable (this configuration not tested)

TABLE 2

| Eigth ¼ Second Response of Fender Bass "A" String only | | | |
|---|---|---|---|
| | | A string (54 Hz) | |
| Example # | Construction | Harmonic | Intensity dB |
| 1 (Sample 1) | Fender Bass A String, nylon wound as purchased | 11<br>12<br>13<br>14 | −25<br>−19<br>−18<br>−11 |
| 1 | Fender Bass A String 4 wrap ePTFE | 2<br>3<br>4<br>7<br>8<br>12 | +5<br>+10<br>+7<br>+7<br>−1<br>−1 |
| 1 (Sample 4) | Fender Bass A String 6 wrap ePTFE | 2<br>3<br>4<br>8<br>10<br>12<br>14 | −3<br>+13<br>−3<br>+16<br>+12<br>+13<br>+16 |

The invention claimed is:

1. A string for a string musical instrument that comprises a wound string including a winding and having a longitudinal axis;

a cover at least partially adhered to the wound string, the cover comprising at least one layer of polymer film, the polymer film being deformable along the longitudinal axis of the string so as to allow movement of the winding along the longitudinal axis.

2. The string of claim 1 wherein the polymer comprises an expanded polytetrafluoroethylene (PTFE), the PTFE being expanded in at least a longitudinal direction to produce a microscopic structure including polymeric fibrils.

3. The string of claim 1 wherein the polymer comprises a porous polytetrafluoroethylene.

4. The string of claim 1 wherein the cover is attached with an adhesive.

5. The string of claim 1 wherein the cover is attached to the wound string with a discontinuous layer of adhesive.

6. The string of claim 1 wherein the cover is attached to the wound string with a continuous layer of adhesive.

7. The string of claim 1 wherein the cover is relatively non-deformable in a longitudinal direction and relatively deformable in a transverse direction; and the cover is wrapped around the wound string with the longitudinal direction of the cover oriented at an angle to the longitudinal axis of the wound string.

8. The string of claim 7 wherein the cover is attached to the wound string with a discontinuous layer of adhesive, the transverse deformability of the cover and the discontinuous layer of adhesive combine to allow movement of the winding parallel to the longitudinal axis of the wound string.

9. The string of claim 7 wherein the cover is attached to the wound string with a continuous layer of adhesive, the transverse deformability of the cover and the continuous layer of adhesive combine to allow movement of the winding parallel to the longitudinal axis of the wound string.

10. The string of claim 2 wherein the cover comprises at least two layers of expanded PTFE, with the two layers at different angles with respect to the longitudinal axis.

11. The string of claim 10 wherein each of the layers of expanded PTFE is bonded to at least one other PTFE layer;

the layer of expanded PTFE closest to the wound string is attached to the wound string with a layer of adhesive that will deform to allow movement of the winding parallel to the longitudinal axis of the wound string.

12. The string of claim 11 wherein the layer of adhesive comprises a discontinuous layer of adhesive.

13. The string of claim 2 wherein the cover comprises at least two layers of expanded PTFE, each layer wrapped approximately parallel to the other.

14. The string of claim 11 wherein the layer of adhesive comprises a continuous layer of adhesive.

15. The string of claim 1 wherein the cover includes a coating adhered to an outside surface of at least one polymer layer of the polymer.

16. The string of claim 1 wherein the string is adapted to be mounted on a musical instrument having a fingering board; and the cover is attached only over a portion of the string adapted to be installed over the fingering board.

17. The string of claim 1 wherein the cover comprises a surface that serves to avoid extraneous noise from the string during play.

18. The string of claim 1 wherein the cover comprises a smooth surface that serves to protect a musician's fingers from abrasion during play.

19. The string of claim 1 wherein the cover extends over essentially the entire string.

20. A musical instrument including the string of claim 1.

21. The string of claim 1 wherein the polymer film is selected from the group consisting of fluorinated ethylene propylene, perfluoralkoxy resin, polytetrafluoroethylene, polyethylene, polypropylene, polyamide, polyimide, polyurethane, and polyester.

22. An improved string for a string instrument that comprises a wound string having a longitudinal axis, a core, and winding wrapped around the core;

a polymeric cover wrapped around the wound string, the polymeric cover being formed from a material being relatively non-deformable in a longitudinal direction and relatively deformable in a transverse direction, the cover being wrapped around the wound string with the longitudinal direction of the cover oriented at an angle to the longitudinal axis of the wound string; and an adhesive layer bonding the polymeric cover to the wound string, the adhesive layer preventing separation of the cover from the wound string while combining with the cover to allow movement of the windings parallel to the longitudinal axis of the wound string.

23. The string of claim 12 wherein the adhesive layer comprises a discontinuous layer of adhesive between the cover and the wound string.

24. The string of claim 22 wherein the adhesive layer comprises a continuous layer of adhesive between the cover and the wound string.

25. The string of claim 22 wherein the polymeric cover comprises multiple layers of polymer.

26. The string of claim 25 wherein the multiple layers of polymer are oriented at an angle to each other and bonded together.

27. The string of claim 25 wherein the multiple layers of polymer are oriented approximately parallel to each other.

28. The string of claim 22 wherein the polymer cover comprises an expanded polytetrafluoroethylene (PTFE), the PTFE being expanded in its longitudinal direction to produce a microscopic structure comprising polymeric fibrils.

29. The string of claim 28 wherein the cover includes a layer of polymer adhered to the outside of the expanded PTFE.

30. The string of claim 22 wherein the adhesive is selected from the group consisting of polyurethane, fluorinated ethylene propylene, and perfluoralkoxy resin.

31. A musical instrument including the string of claim 22.

32. The string of claim 22 wherein the polymeric cover is selected from the group consisting of fluorinated ethylene propylene, perfluoralkoxy resin, polytetrafluoroethylene, polyethylene, polypropylene, polyamide, polyimide, polyurethane, and polyester.

33. A musical instrument string made by the process comprising:

providing a string having a longitudinal axis and a transverse direction;

covering the string with a cover, the cover being relatively deformable along the longitudinal axis of the string and relatively non-deformable along the transverse direction of the string; and attaching the cover to the string so that the cover remains affixed to the string during play.

34. The musical instrument string made in accordance with claim 33, that further comprises forming the cover with at least two layers of polymer material.

35. The musical instrument string made in accordance with claim 33 that further comprises attaching the cover to the string with an adhesive.

36. The process of claim 33 that further comprises mounting the string with the attached cover on a musical instrument.

37. A musical instrument string made by the process comprising:

providing a string having a longitudinal axis;

covering the string with a cover of polymeric film;

attaching the cover to the string so that the cover remains affixed to the string during play;

wherein the cover is substantially non-dampening to the tonal quality of the string.

38. The process of claim 37 that further comprises mounting the string with the attached cover on a musical instrument.

39. A musical instrument having strings that are fingered during play that comprises at least one wound string including a winding and having a longitudinal axis;

a cover around the wound string, the cover comprising at least one layer of polymer film at least partially adhered to the string, the polymer film being sufficiently deformable along the longitudinal axis of the string so as to maintain the tonal quality of the string; and wherein the cover avoids squeaking of the wound string when played.

40. A musical instrument string comprising a core;

a wire having a polymeric coating attached around the wire to form a coated wire;

wherein the coated wire is wound around the core to form a winding.

* * * * *